United States Patent [19]

Gerriet

[11] Patent Number: 4,575,273

[45] Date of Patent: Mar. 11, 1986

[54] BINDER FOR CONTINUOUS OR SEPARATED COMPUTER PRINTOUT SHEETS

[75] Inventor: Jacques Gerriet, Fleury-sur-Andelle, France

[73] Assignee: Arianex Systemse, Societe Anonyme francaise, Bernay, France

[21] Appl. No.: 646,926

[22] Filed: Sep. 4, 1984

[30] Foreign Application Priority Data

Sep. 22, 1983 [FR] France ..... 83 15078

[51] Int. Cl.[4] ..... B42F 3/02; B42F 13/20; B42F 13/28; B42F 15/00

[52] U.S. Cl. ..... 402/75; 402/29; 402/32; 402/73; 402/502

[58] Field of Search ..... 402/29, 30, 31, 32, 402/33, 34, 36, 42, 43, 56, 75, 502, 70, 73, 5

[56] References Cited

U.S. PATENT DOCUMENTS

| | | | |
|---|---|---|---|
| 908,597 | 1/1909 | Morden | 402/75 |
| 1,577,697 | 9/1925 | Douglas | 402/73 |
| 1,827,592 | 11/1929 | Lewis | 402/43 |
| 4,527,923 | 7/1985 | Waldman | 402/75 |

FOREIGN PATENT DOCUMENTS 2227564 6/1973 Fed. Rep. of Germany .

*Primary Examiner*—Robert L. Sprull
*Assistant Examiner*—Mark E. Prado
*Attorney, Agent, or Firm*—Browdy & Neimark

[57] ABSTRACT

A binder for computer print out paper fits into a standard sized file cabinet. It comprises a series of hinged together panels, two opposite ones of which hold along one edge a pair of rings retained in aligned slots. The rings are capable of movement in two different directions, and such rings hold the paper within the binders.

3 Claims, 4 Drawing Figures

BINDER FOR CONTINUOUS OR SEPARATED COMPUTER PRINTOUT SHEETS

FIELD OF INVENTION

This invention relates to a binder for continuous or separated computer printout sheets.

BACKGROUND

For filing of these sheets, binders now used are of the suspended type or of type to be filed on end on a shelf and comprising along the folding line separating their bottom and back, two means for fastening of the sheets which are solid with the bottom and able to go through two perforations corresponding to one another along the two opposite sides of the stacked sheets; these means are generally flexible rods bent on a removable rail applied against the upper sheet between the two perforations corresponding to one another along the two opposite sides of the stacked sheets; these means are generally flexible rods bent on a removable rail applied against the upper sheet between the two perforations and having slides for wedging the free ends of the two flexible rods.

Although in some cases, mobility has been provided for one of the means along the edge of the binder, to allow it to adapt to the width of the sheets and consequently to the distance separating the two rows of perforations, the binders do not allow folding of the sheets on themselves without risk of tearing them, which requires filing means suited to the very special dimensions of the sheets, dimensions which always exceed the standard dimensions of current documents. Further, the fastening means do not allow easy looking at the part located at the top of the sheets.

SUMMARY

The present invention aims at remedying these drawbacks by providing a binder able to be filed in any cabinet or file drawer for filing of documents of current standard dimensions corresponding to size international A4. i.e. 21 cm/29.7 cm.

For this purpose, in the binder it relates to, which is provided for suspended or upright filing, one of the two means for fastening the sheets is fastened in the vicinity of the upper edge of the bottom panel and the other in the vicinity of the upper edge of the top panel and this fastening is achieved with at least two degrees of freedom, i.e. a possiblity of crosswise displacement parallel to the bottom or top panel and a possibility of pivoting around an exis parallel to the folding lines connecting the bottom and top panels to the back which separates them, contained in the plane of the panel, and passing through the point of intersection of the fastening means with its supporting panel.

According to a simple embodiment of the invention, the edge of the bottom or top element exhibits a slot which is parallel to it and which is located in the extension of the other slot and each fastening means consists of an opening ring.

Preferably, to facilitate looking at the sheets and particularly their upper parts, the diameter of the opening rings is approximately equal to three times the distance separating two perforations of the same row of perforations of a sheet. Thus, the presence of the rings does not hinder opening the sheets of the stack, even if not separated, because the rings are engaged in the second perforations of each sheet and the distance separating the first perforation of the adjacent edge of the sheet is equal to half the interval between perforations.

BRIEF DESCRIPTION OF DRAWINGS

In any case, the invention will be better understood with the aid of the following description, with reference to the accompanying diagrammatic drawing, showing an embodiment of this binder.

DETAILED DESCRIPTION OF EMBODIMENTS

Figure 1:
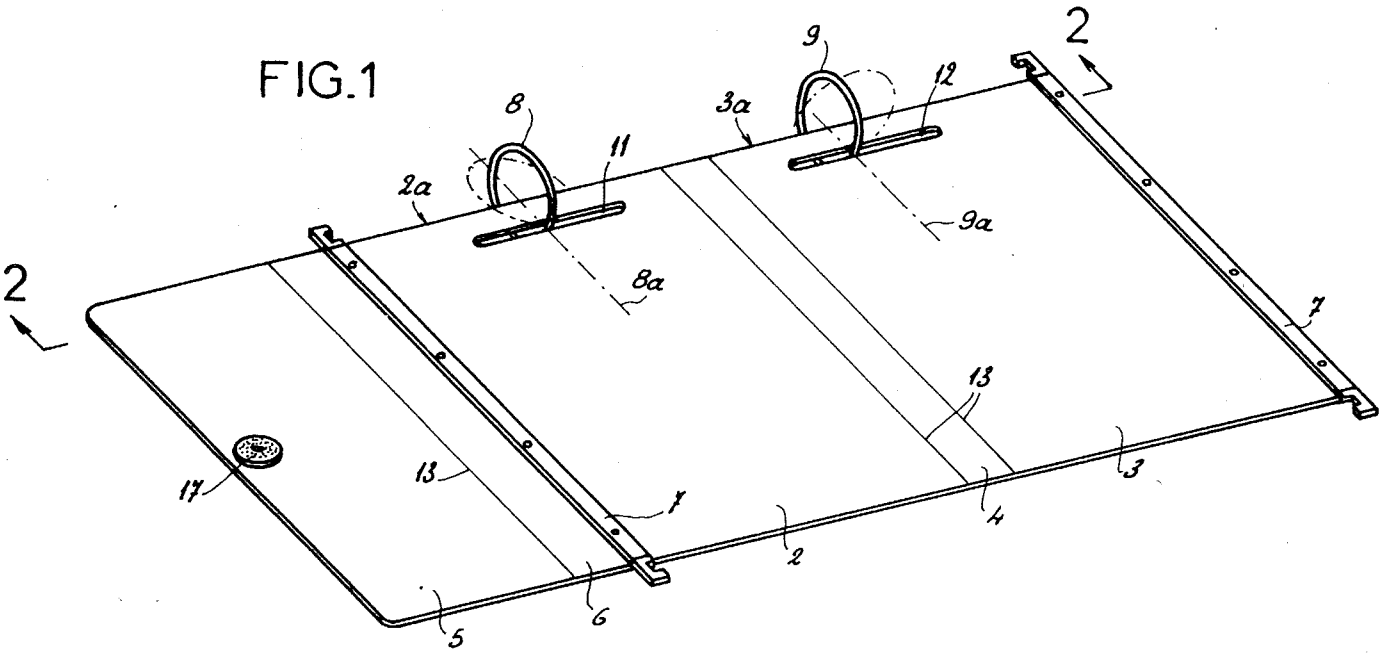
FIG. 1 is a perspective view in open position without sheets.
Figure 2:
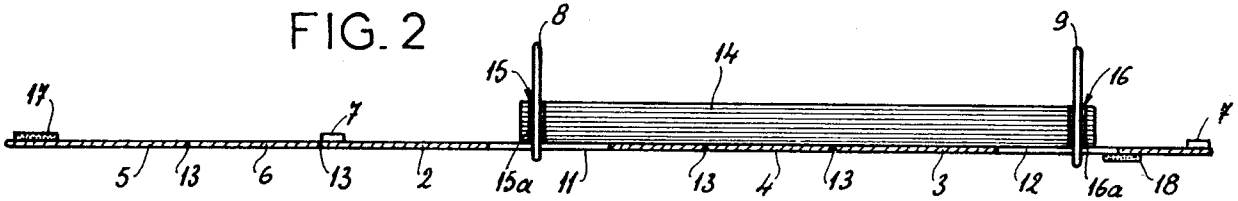
FIG. 2 is a cross section along 2—2 of FIG. 1, in open position, with sheets.

The body of the binder according to the invention is of the type made by cutting from a relatively rigid sheet, such as a rather tough plastic. In this sheet of a general rectangular shape are made folding lines which delimit a bottom 2, a top 3, a first back 4 separating the bottom 2 and the top 3, a flap 5 and a second back 6 separating the bottom 2 and flap 5. Two suspension rods 7 of known type, usually placed on suspended files, are fastened on the end edge of the top 3 and on the corresponding edge of the bottom 2.

Figure 3:
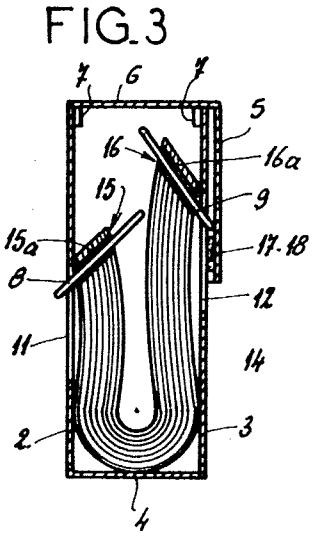
FIG. 3 is a cross section along 2—2 of FIG. 1, in closed position with sheets.

In the binder according to the invention, the means for fastening the printout sheets are provided along one of the edges located in the extension of one another of the bottom 2 and top 3, this arrangement offering the advantage of being able to accomodate these printout sheets in a binder of current size, e.g. size A4 (21 cm/29.7 cm), the sheets naturally being folded on themselves when the binder is closed as in FIG. 3. In the example shown in the drawing, two fastening means (generally 8 and 9) are provided, one of which is fastened at the bottom 2 and the other at the top 3. These fastening means each consists of an opening ring 8 and 9, respectively, one ring 8 of which is engaged in a slot 11 made along the edge 2*a* of bottom 2, and the other ring 9 is engaged in a slot 12 along the edge 3*a* of the top 3. The two slots 11 and 12 are not only parallel to the edges 2*a* and 3*a* of the bottom 2 and top 3 but, in addition, they are located in the extension of one another, i.e. they lay along the same line.

Therefore, it can be seen that each fastening means 8 and 9 exhibits two degrees of freedom, since it is mobile crosswise in the slot 11 or 12 which is associated with it and can also pivot around an axis 8*a*, 9*a* parallel to the folding lines designated by reference line 13 separating the bottom 2, the top 3, the flap 5 and the two backs 4 and 6 from one another. The pivoting axis 8*a* and 9*a* of the rings 8 and 9 are, in addition, contained in the plane of the bottom 2 and top 3 elements and each of these axis passes through the point of intersection of the ring 8, 9 with this element 2, 3.

Each ring 8 and 9, which constitutes one of the means for fastening the printout sheets 14 to the binder, is intended to be engaged in the second perforation 15*a* of the corresponding row of perforations 15 or 16, with which the sheets 14 are provided, each row 15 and 16 being aligned with one of the pivoting axis 8*a*, 9*a* of the corresponding ring 8,9.

The presence of the slots 11 and 12 obviously makes it possible to adapt the spacing of the rings 8 and 9 to the width of the sheets 14 and more precisely to the interval separating the rows of perforations 15 and 16.

Further, in combination with the possibility of pivoting of each ring (8 and 9) around its pivoting axis (8*a*, 9*a*), the possibility of crosswise displacement along the associated slot (11,12) allows folding of the sheets (14) on themselves with the binder is closed by folding the top 3 on the bottom 2 and the flap 5 on the top 3 as shown in FIG. 3.

As is clear from an examination of FIG. 3, this double degree of freedom of the rings 8 and 9 enagles them to accomodate the lateral edges of the sheets 14 without risk of tearing them.

Figure 4:
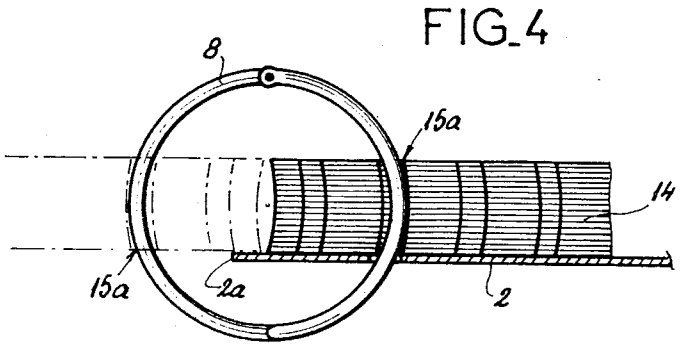
FIG. 4 is a partial view, on an enlarged scale, showing an embodiment of the means for fastening the sheets.

It is indicated above that each ring 8, 9 is engaged in the second perforation 15*a*, 16*a* of the row 15, 16 corresponding to it. According to an advantageous characteristic of the invention, complete inspection of each sheet 14 is facilitated by providing that the first perforation of each row 15 and 16 be located at a distance from the corresponding edge of the sheet equal to half of the interval separating two perforations of the same row 15, 16, and that the diameter of each ring 8, 9 be approximately equal to three times the interval separating two perforations of the same row, 15 16. As clearly illustrated in FIG. 4, this arrangement allows the pivoting of each sheet 14 through an angle of 180° around an axis going approximately through the center of two rings 8 and 9, even if the sheets 14 are not separated.

This binder therefore makes possible filing of the printout sheets, whether separated or not, in current dimensions, i.e. with filing equipment of current dimensions without impairing the possibilities of looking at these sheets and without risk of tearing them wholly or partially.

In a way known in the art to keep this binder in closed position, as shown in FIG. 3, the inside face of the flap 5 carries at least a disk 17, for example of the type comprising hooks, buckles, loops or the like of plastic, while the top 3 carries on its outside a disk 18 complementary of disk 17 and allowing their mutual fastening and consequently keeping this binder closed by keeping the flap 5 folded down over the top 3.

It goes without saying and as comes out from the above, the invention is not limited to the single embodiment of this binder which is described above by way of nonlimiting example; on the contrary, it takes in all variant embodiments.

What is claimed is:

1. A binder for holding continuous unseparated or separated printout sheets, comprising a bottom panel, a top panel, a first back panel connecting the bottom and top panels, a second back panel extending from one said bottom and top panels, a flap hinged to said second back panel, said panels being connected by fold lines and having free edges adjacent said fold lines, and at least two means for fastening of the separated or unseparated printout sheets, one of the two means for fastening of the sheets being connected to said bottom panel in the vicinity of one of the free edges thereof and the other fastening means being connected in the vicinity of the corresponding free edge of the top panel, said fastening being made with at least two degrees of freedom including crosswise displacement parallel to said free edges of the bottom and top panels, and pivoting around an axis parallel to the fold lines connecting the bottom panel and the top panel to the back panel which separates them, said axis being contained in the plane of the panels and passing through a point of intersection of the fastening means with said panels.

2. A binder according to claim 1, wherein the bottom and top panel each has a slot therein which is parallel to said free edge, said slots laying in the same line, and wherein fastening means consists of an opening ring which extends through a said slot.

3. A binder according to claim 2, wherein each printout sheet has opposing edges each having a row of perforations, and each opening ring has a diameter which is approximately equal to three times the distance separating two perforations of the same row of perforations of a sheet.

* * * * *